US006769638B2

(12) United States Patent
Munezane et al.

(10) Patent No.: US 6,769,638 B2
(45) **Date of Patent: *Aug. 3, 2004**

(54) FUEL INJECTION VALVE

(75) Inventors: Tsuyoshi Munezane, Hyogo (JP); Mamoru Sumida, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/996,581

(22) Filed: Nov. 30, 2001

(65) Prior Publication Data

US 2002/0125347 A1 Sep. 12, 2002

(30) Foreign Application Priority Data

Dec. 4, 2000 (JP) ..... 2000-368580

(51) Int. Cl.[7] ..... B05B 1/00

(52) U.S. Cl. ..... 239/596; 239/533.12; 239/533.14; 239/552; 239/585.1; 239/900

(58) Field of Search ..... 239/533.12, 596, 239/533.14, 552, 585.1, 900, 585.2, 585.3, 585.4, 553

(56) References Cited

U.S. PATENT DOCUMENTS 5,762,272 A * 6/1998 Tani et al. ..... 239/596
5,931,391 A * 8/1999 Tani et al. ..... 239/533.12
6,089,476 A * 7/2000 Sugimoto et al. ..... 239/596
6,161,780 A * 12/2000 Sugimoto et al. ..... 239/533.12
6,186,418 B1 * 2/2001 Tani ..... 239/533.12
6,394,367 B2 * 5/2002 Munezane et al. ..... 239/533.12

FOREIGN PATENT DOCUMENTS

| | | |
|---|---|---|
| JP | 8-303321 A | 11/1996 |
| JP | 9-14090 | 1/1997 |
| JP | 10-122096 | 5/1998 |
| JP | 11-72067 | 3/1999 |
| JP | 11-200998 | 7/1999 |
| JP | 11-264365 | 9/1999 |
| JP | 11-264365 A | 9/1999 |
| JP | 2000-97129 A | 4/2000 |
| JP | 2002-130074 A | 5/2002 |

* cited by examiner

*Primary Examiner*—Dinh Q. Nguyen
(74) *Attorney, Agent, or Firm*—Sughrue Mion, PLLC

(57) ABSTRACT

A fuel injection valve including an orifice plate having a plurality of injection orifices, a valve seat in the upstream section of the injection orifices and has a cylindrical fuel flow path formed therein, a fuel cavity formed between the fuel flow path and the orifice plate directly above the injection orifices, and a valve member supported for its reciprocations to settle in and lift off the valve seat. The relationships among dimensions are $\phi D1+\phi d<\phi P$ and $t<\phi d$, where $\phi D1$ is the diameter of the fuel flow path, $\phi d$ the diameter of the injection orifices, $\phi P$ the diameter of a pitch circle with its center coinciding with the axis of the fuel flow path, and t the depth in the axial direction of the fuel cavity.

2 Claims, 9 Drawing Sheets

A – A

B – B

C – C

FUEL INJECTION VALVE

BACKGROUND OF THE INVENTION

1. Field of the Invention

This invention relates to a fuel injection valve, more particularly to a fuel injection valve used for an internal combustion engine.

2. Description of the Related Art

Fuel injection valves accelerating atomization of fuel used so far include, for instance, the one disclosed in Japanese Published Unexamined Patent No. 2000-104647. FIG. 13 is a cross-sectional elevation of a fuel injection valve disclosed in that publication, FIG. 14 an enlarged view of the lower end of the fuel injection valve of FIG. 13, and FIG. 15 a view of the bottom of the fuel injection valve of FIG. 14 seen from the direction shown by arrow E in the Figure.

The illustrated fuel injection valve 1 includes an electromagnetic coil 3, a fixed iron core 4 and metal plates 5 defining a magnetic current path, all disposed in a resin housing 2. The electromagnetic coil assembly 3 consists of a resin bobbin 3*a*, a coil 3*b* being wound around the outer periphery of the bobbin 3*a*, and a terminal 6 formed for connecting to an external source of electric power. The resin housing 2 is molded around the electromagnetic coil assembly 3.

An adjuster 8 for adjusting the loads on a compression spring 7 is secured to the inside of the fixed iron core 4. Each of the two metal plates 5 forming a magnetic current path is fixed at one end to the fixed iron core 4 by welding and is welded at the other end to an electromagnetic pipe 9 forming a magnetic current path. A non-magnetic pipe 11 is situated in the space between the fixed iron core 4 and the magnetic pipe 9 and secured thereto in a way enabling a movable iron core 10 situated within the magnetic pipe 9 to move up and down.

A needle pipe 12 is welded and secured to one end of the movable iron core 10. The movable iron core 10 is abutting at the other end (or the end of the needle pipe 12 whereto the movable iron core 10 is secured) against a compression spring 7, and a valve head 101 is fixed as a valve to the other end of the needle pipe 12. The valve head 101 is guided to a valve seat 102 situated within the magnetic pipe 9 and is situated in a seating section 102*a* of the valve seat 102 in a way enabling its settling in and lifting off the seating section 102*a*. The outer periphery of the section of the valve head 101 guided by the valve seat 102 is processed into a polygonal shape, thus giving space between a guiding section 102*b* of the valve seat 102 and the valve head 101 for fuel to flow through. An orifice plate 104 having a plurality of fuel injection orifices 103 is situated at the lower end of the valve seat 102, as well illustrated in FIGS. 14 and 15. Each of the injection orifices 103 is formed to be oblique from axis C of the fuel injection valve at a given angle.

In such conventional fuel injection valves like this, the valve head 101 is moved up and down by an electromagnetic driving means provided by the electromagnetic coil 3, the movable iron core 10 and other members locating upwards to open and close the valve through the settling in and lifting off the valve seat 102 of the valve head 101. Fuel flows through the space between the valve head 101 and the valve seat 102 into a fuel cavity 105 situated beneath the lower end of the valve head 101 and above the orifice plate 104, and then injected out of the injection orifices 103 formed in the orifice plate 104.

The fuel injection valve 1 as shown in FIGS. 13–15 wherein the direction of fuel injection is defined by the angle of inclination of the injection orifices 103 formed in the plate 104 is imperfect in that it is difficult to achieve a satisfactorily large spray angle for the injected fuel because the fuel flowing through the fuel cavity 105 onto the orifice plate 104 generally gathers in the central section from the outer periphery. For achieving a large spray angle (say, 15° or more) by using a double-spray type valve it is necessary to form the injection orifices 103 having a large angle of inclination, and it is difficult to form such largely inclined orifices with small diameters, meaning that it is difficult to achieve a satisfactory atomization of fuel for which orifices must have small diameters. If largely inclined orifices with small diameters are successfully formed, the processing of such orifices in the orifice plate will involve a considerable cost. In case of an orifice plate in which more than six injection orifices are to be formed for the acceleration of atomization, it is particularly difficult to form these orifices because their diameters must be reduced further.

Although it is possible to govern the direction of fuel injection and to induce larger spray cone angles by increasing L/ϕd, or the ratio of depth L of the injection orifices 103 to be formed in the orifice plate 104 to diameter ϕd, or the diameter of the injection orifice, this could result in an impaired atomization. Further, it is difficult to perform the work to form the injection orifices 103 with larger L/ϕd values in the orifice plate 104, and the work to form the injection orifices 103 having larger angles of inclination as well involves a significant manufacturing cost increase because it is difficult to form such injection orifices in the orifice plate 104.

Although a fuel injection valve having an orifice plate with a fuel cavity formed wherein has been proposed as described in the Japanese Published Unexamined Patent Application Hei 10-122096, it is difficult to manufacture such an orifice plate, and thus involving a significant manufacturing cost increase.

In fuel injection valves injecting spray flows from a plurality of injection orifices to a plurality of directions, injection orifices are disposed along the circumferences of a plurality of concentric circles as described in Japanese Published Unexamined Patent Application Hei 11-72067. However, such fuel injection valves are imperfect in that they fail to produce spray flows consisting of fuel droplets of uniform size because of an inconsistency in the particle size composition of the fuel flows from the injection orifices disposed along the circumferences between inner and outer circles.

SUMMARY OF THE INVENTION

The present invention provides a low-priced and efficient fuel injection valve enabling the production of atomized uniform spray flows at a large spray angle (say, 15° and more) as well as the acceleration of atomization of injected fuel and including an orifice plate in which injection orifices are easily formed.

According to one form of the present invention, a fuel injection valve includes an orifice plate having a plurality of (more than six) injection orifices formed therein, a valve seat with a valve seating formed in the upstream section of said injection orifices, a single cylindrical fuel flow path formed in said valve seat, a fuel cavity formed in the space between said fuel flow path and said orifice plate having a plurality of said injection orifices and situated directly above a plurality of said injection orifices, and a valve member supported by said valve seat in a way enabling reciprocations and having an abutting section that can be settled in and lifted off a valve seating formed in said valve seat, and produces a plurality of spray flows consisting of a plurality of fuel flows injected out of injection orifices disposed in said orifice plate, wherein a plurality of injection orifices formed in said orifice plate are disposed only along ØP, or the diameter of a single pitch circle with its center coinciding with the axis of the fuel flow path, and the diameter of the fuel flow path (ϕD1), the diameter of each of the injection orifices (ϕd), ϕP and the depth in the axial direction of the fuel cavity (t) are made have the relationships ϕD1+ϕd<ϕP and t<ϕd.

In a preferred embodiment, of a plurality of said injection orifices formed in said orifice plate, each group of injection orifices producing a single spray flow is disposed at an equal pitch along the circumference of the pitch circle.

In a preferred embodiment, the angle formed at the fuel injecting side of the orifice plate by the axis of each of the injection orifices disposed in said orifice plate with an imaginary straight line which passes through the center of each of the injection orifices and is parallel to the axis of the fuel injection valve increases with an increase in the distance between each injection orifice and the basic axis which passes through the centre of the orifice plate and crosses at a right angle the radial component of the injecting direction of fuel spray flows in each group of injection orifices producing a single spray flow of a plurality of said injection orifices formed in said orifice plate.

In a preferred embodiment, a plurality of said injection orifices formed in said orifice plate consist of at least two different groups of injection orifices with different diameters in a fuel injection valve wherein ϕD1, ϕd1 (the diameter of the injection group having the largest diameter), ϕP and t are made to have the relationships ϕD1+ϕd1<ϕP and t<ϕd1.

DESCRIPTION OF PREFERRED EMBODIMENTS

Figure 1:
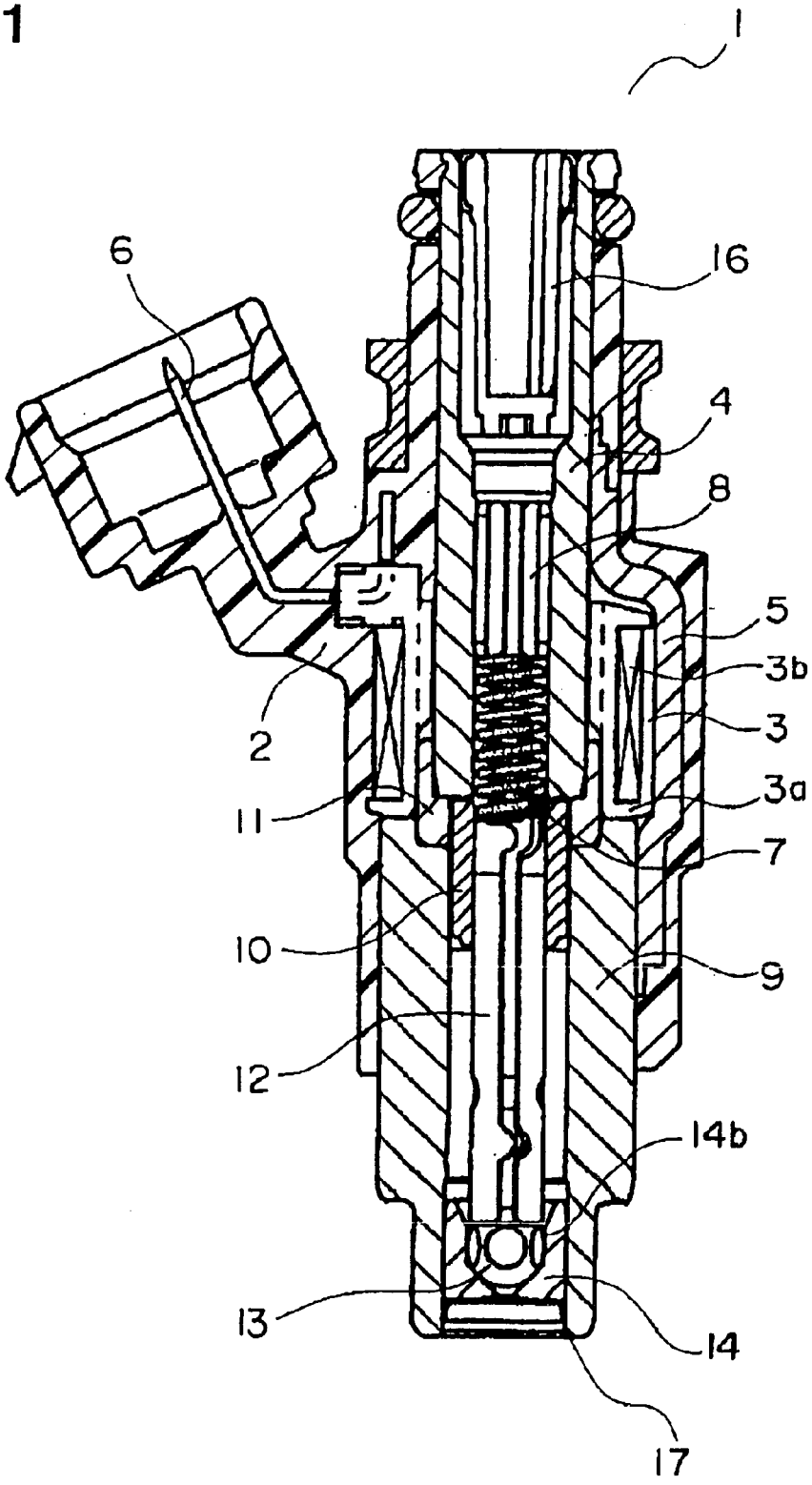
FIG. 1 is a longitudinal cross-sectional elevation showing the entire structure of a first embodiment of a fuel injection valve according to the present invention.

A number of preferred embodiments of a fuel injection valve according to the present invention will be described while referring to the accompanying drawings. FIG. 1 is a longitudinal cross-sectional elevation showing the entire structure of a first embodiment of a fuel injection valve according to the present invention. The fuel injection valve 1 includes an electromagnetic coil 3, a fixed iron core 4 and metal plates 5 defining a magnetic current path, all disposed in a resin housing 2. The electro-magnetic coil assembly 3 consists of a resin bobbin 3*a*, a coil 3*b* being wound around the outer periphery of the bobbin 3*a*, and a terminal 6 formed for connecting to an external source of power. The resin housing 2 is molded around the electromagnetic coil assembly.

An adjuster 8 for adjusting the loads on a compression spring 7 is secured to the inside of the fixed iron core 4. Each of the two metal plates 5 forming a magnetic current path is fixed at one end to the fixed iron core 4 by welding and is welded at the other end to an electromagnetic pipe 9 forming a magnetic current path. A non-magnetic pipe 11 is situated in the space between the fixed iron core 4 and the magnetic pipe 9 and secured thereto in a way enabling a movable iron core 10 situated within the magnetic pipe 9 to move up and down.

A needle pipe 12 is secured by welding to one end of the movable iron core 10. The needle pipe 12 is abutted against the compression spring 7 at the end whereto the movable iron core 10 is secured, and a ball 13 to function as a valve member is secured by welding to the other end the needle pipe. The ball 13 is guided to a valve seat 14 situated within the electromagnetic pipe 9 and has an abutting section enabling settling in and lifting off a valve seating 14*a*, or the seating section of the valve seat 14. A part of the outer periphery of the ball 13 is cut and processed into a pentagonal shape, thus giving space between a guiding section 14*b* of the valve seat 14 and the ball 13 for fuel to flow through.

A single fuel flow path 14*c* in a cylindrical form with axis CL coinciding with the axis of the fuel injection valve is formed at the lower end of the valve seat 14 having the valve seating 14*a*. A fuel cavity 14*d* is formed in the region wherein the fuel flow path 14*c* is included as a circular concave with its axis coinciding with the axis of the fuel injection valve.

Figure 2:
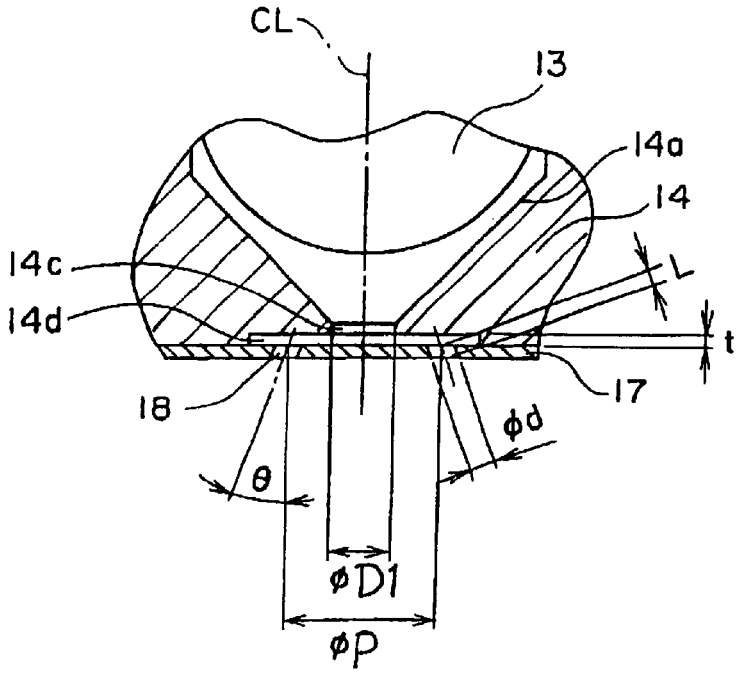
FIG. 2 is a partial cross-sectional elevation showing an enlarged part of the fuel injection valve of FIG. 1.
Figure 3:
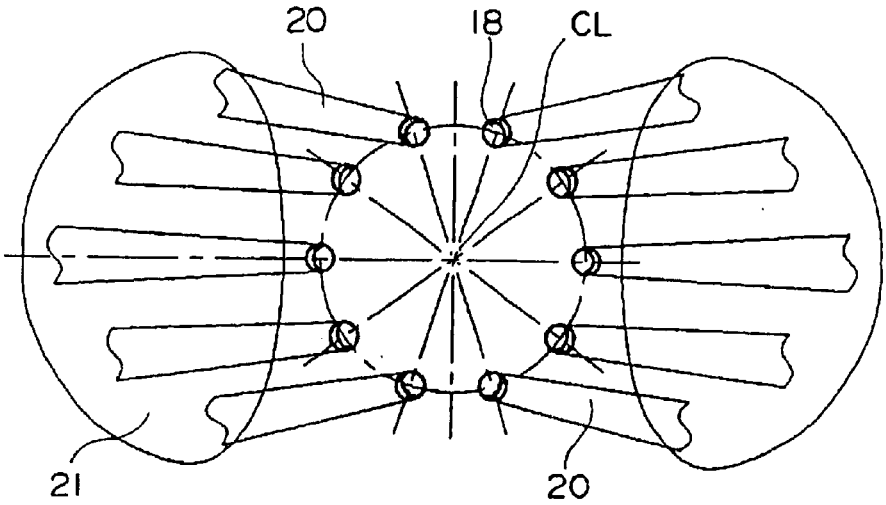
FIG. 3 is a schematic plan view showing the disposition of the injection orifices in the orifice plate of a fuel injection valve according to the present invention.
Figure 4:
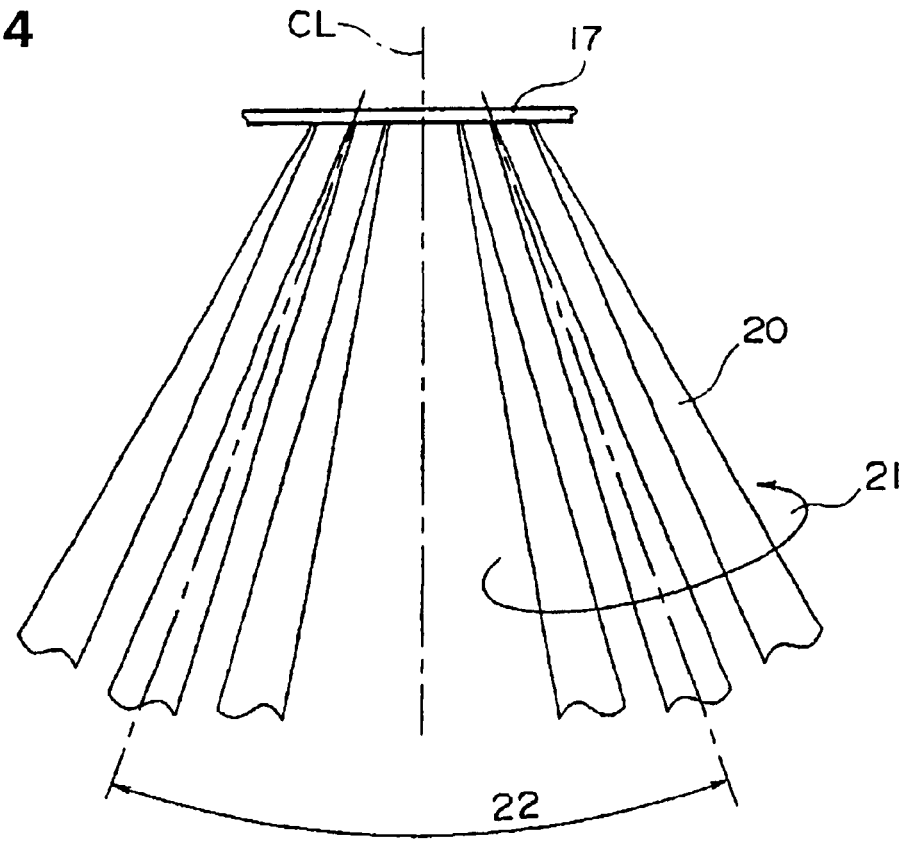
FIG. 4 is a schematic side view showing the disposition of the injection orifices in the orifice plate of a fuel injection valve according to the present invention.

As well shown in FIGS. 2, 3 and 4, an orifice plate 17 having a plurality of (more than six) injection orifices 18 is situated at the lower end of the valve seat 14 in a way to close the fuel cavity 14*d* by covering the lower end whereof, although the fuel cavity 14*d* formed in the space between the orifice plate 17 and the fuel flow path 14*c* is connected to each of the injection orifices 18 in the orifice plate 17. A plurality of injection orifices 18 formed in the orifice plate 17 are disposed only along diameter ϕP of a single pitch circle with its center coinciding with axis CL of the fuel flow path 14, or axis CL of the fuel injection valve, and as shown in FIG. 2, the diameter of the fuel flow path 14*c* (ϕD1), the diameter of each of the injection orifices 18 (ϕd), ϕP and the depth in the axial direction of the fuel cavity 14*d* (t) are made to have the relationships ϕD1+ϕd<ϕP and t<ϕd.

The illustrated fuel injection valve operates in the following manner. When electric current is supplied to the coil assembly 3 through the terminal 6, magnetic fluxes are generated in the magnetic current path formed by the fixed iron core 4, the metal plates 5, the electromagnetic pipe 9 and the movable iron core 10 to pull up the movable iron core 10 towards the fixed iron core 4 by the electromagnetic attraction, causing the needle pipe 12 joined to and formed integrally with the movable iron core 10 and the ball 13, or the valve member welded and secured to needle pipe 12, to move upwards, thus giving fuel space to flow through between the valve seating 14*a* of the valve seat 14 and the ball 13 towards the orifices 18 formed in the orifice plate 17 for fuel injection.

Fuel is supplied to the fuel injection valve 1 (the injector) shown in FIG. 1 through a delivery pipe (not illustrated) from the upper end of the injection valve 1 and flows through a filter 16, and then through an adjuster 8 and a compression spring 7, both situated within the fixed iron core 4, the movable iron core 10 and the needle pipe 12. After passing through the space between the guiding section 14*b* of the valve seat 14 and the outer periphery of the ball 13, and then through the cylindrical fuel flow path 14*c* formed in the middle of the seating section 14*a*, fuel flows into the fuel cavity 14*d*, where it collides with the orifice plate 17 situated in the lower end of the fuel cavity 14*d* and diverges radially from the central section of the orifice plate 17 and then flows into the injection orifices 18 disposed radially at the outer section of the orifice plate 17 and finally injected out of the injection orifices 18 at angles causing a spread of projectiles.

FIGS. 2, 3 and 4 illustrate the fuel injection valve 1 wherein a plurality of injection orifices 18 are disposed only along diameter ϕP of a single pitch circle in the orifice plate 17, and the diameter of the cylindrical fuel flow path 14*c* (ϕD1), the diameter of each of the injection orifices 18 (ϕd), ϕP and the depth in the axial direction of the fuel cavity 14*d* (t) are made to have the relationships ϕD1+ϕd<ϕP and t<ϕd. Because of the structure, a turbulence occurs among fuel flows 20 to induce a satisfactory atomization of the fuel injected from the injection orifices, and due to a similar level of atomization among the fuel flows 20, it is possible to produce uniform spray flows.

Furthermore, because fuel is directed in the fuel cavity 14*d* to flow outwards from the central section, a level of spray angle 22 as that provided by a fuel injection valve in which fuel is not directed to flow outwards in its fuel cavity is achievable by the juel injection valve 1 having the injection orifices 18 with smaller angle of inclination, thus allowing the orifice plate 17 to have a structure involving a lower manufacturing cost.

Figure 5:
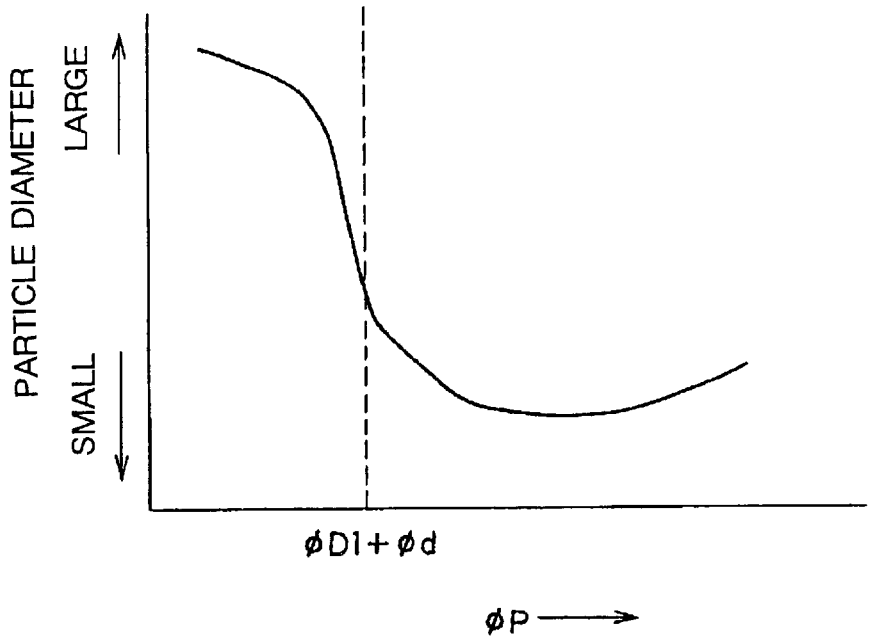
FIG. 5 is a graph showing the results of measurements of the dimensions of relevant members (ϕD1, ϕd, ϕP and t) of the orifice plate wherein t and Ød are made to have the relationship t<ϕd and the atomization of the fuel by a fuel injection valve according to the present invention.

FIG. 5 is a graphic display of the relationship between diameters ϕD1, ϕd and ϕP and fuel atomization in a fuel injection valve wherein t and ϕd are made to have the relationship t<ϕd. As seen from FIG. 5, the particle size in a fuel spray from a fuel injection valve wherein t and ϕd are made to have the relationship t<ϕd remains large when ϕP is less than the value of ϕD1+ϕd (shown by the broken line), while it plunges when ϕP increases and approximates to the value of ϕD1+ϕd, and remains satisfactorily small when ϕP is greater than the value of ϕD1+ϕd. Thus, the particle size in a fuel spray can be reduced satisfactorily if fuel is injected with a fuel injection valve wherein ϕD1, ϕd and ϕP are made to have the relationship ϕD1+ϕd<ϕP.

Figure 6:
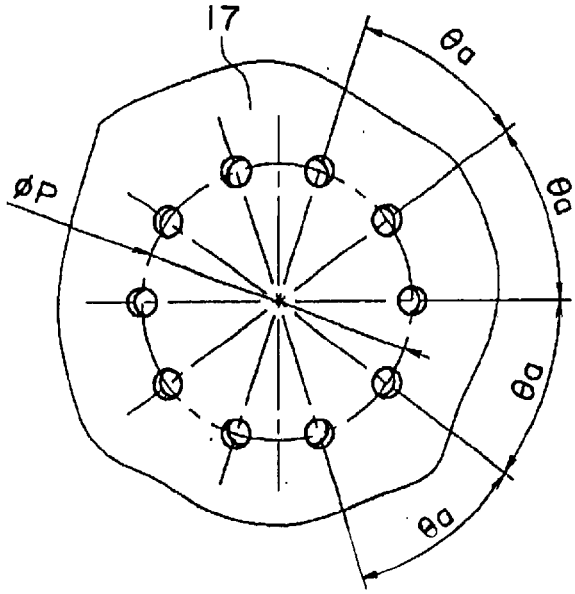
FIG. 6 is a partial plan view showing the orifice plate of a second embodiment of a fuel injection valve according to the present invention.
Figure 7:
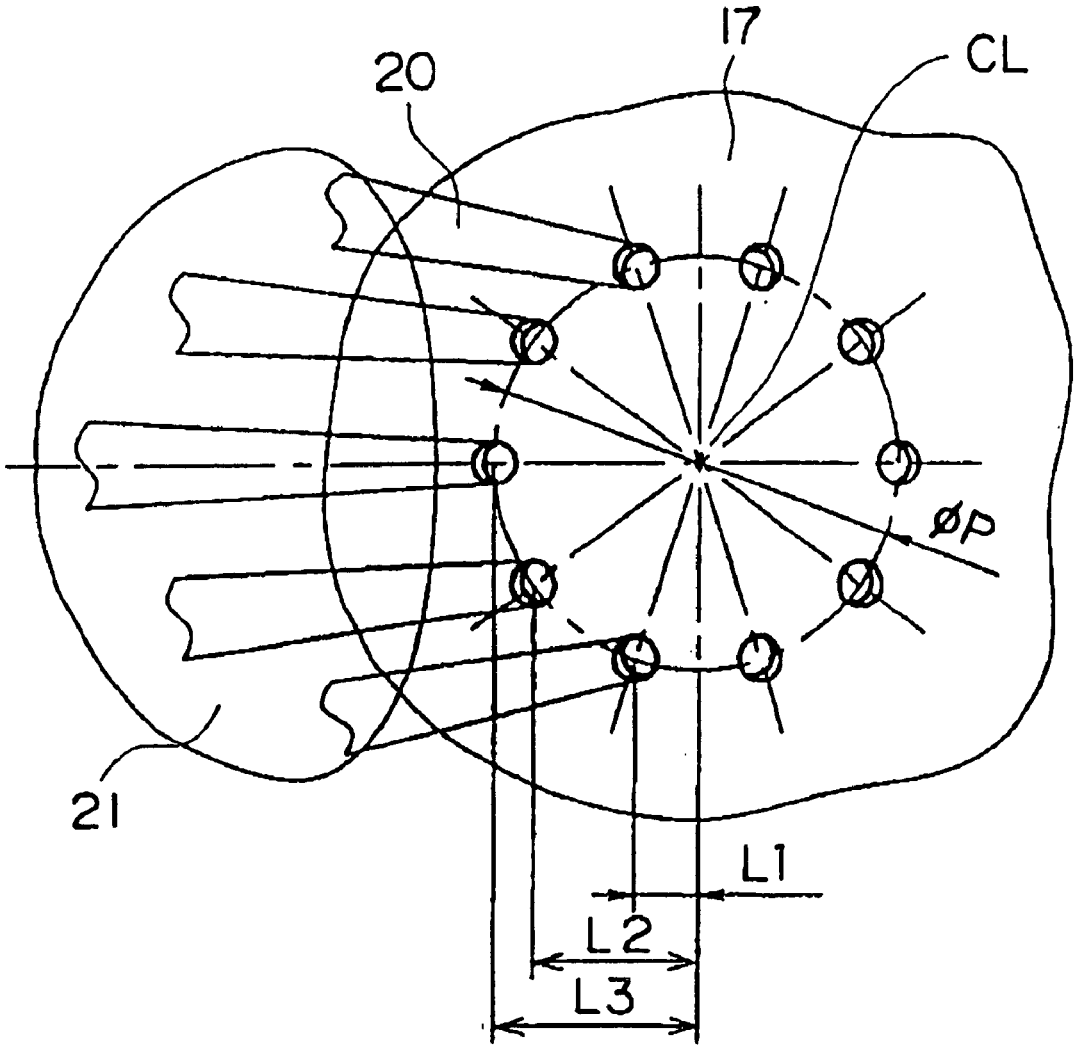
FIG. 7 is a partial plan view showing the relationship between the injection orifices and injected fuel in the orifice plate of a third embodiment of a fuel injection valve according to the present invention.
Figure 8:
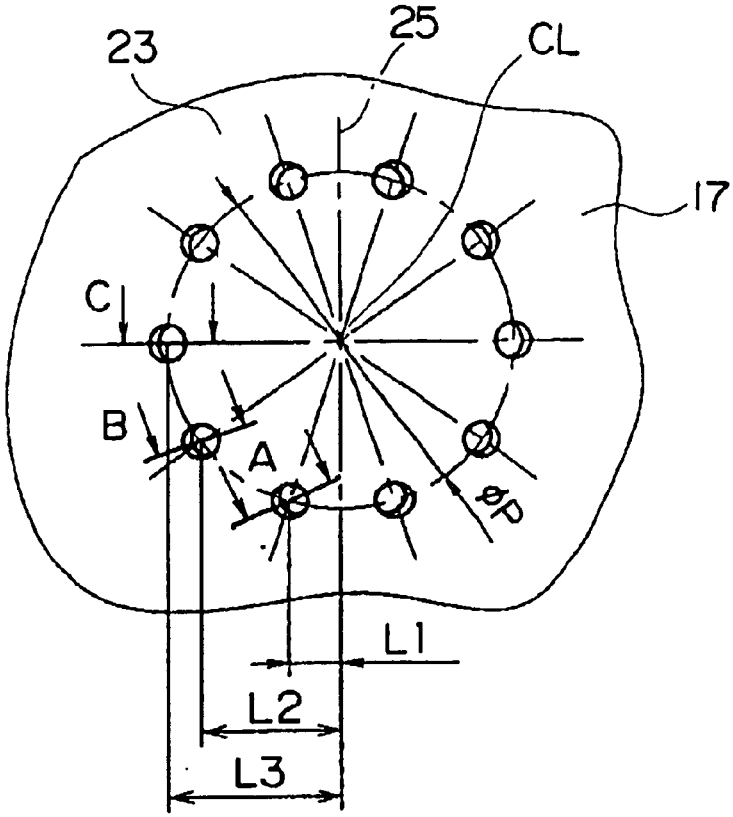
FIG. 8 is a partial plan view showing the disposition of the injection orifices in the orifice plate of a third embodiment of a fuel injection valve according to the present invention.
Figure 9:
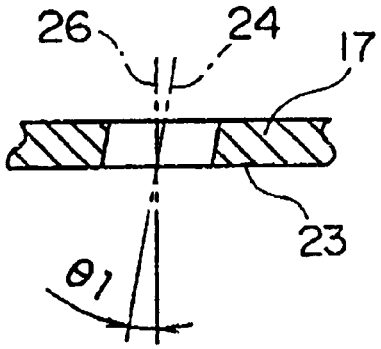
FIG. 9 is a partial longitudinal cross-sectional view showing the injection orifice having the first angle of inclination of a third embodiment of a fuel injection valve according to the present invention.
Figure 10:
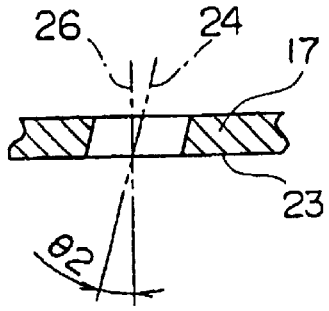
FIG. 10 is a partial longitudinal cross-sectional view showing the injection orifice having the second angle of inclination of a third embodiment of a fuel injection valve according to the present invention.
Figure 11:
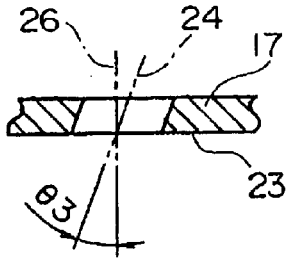
FIG. 11 is a partial longitudinal cross-sectional view showing the injection orifice having the third angle of inclination of a third embodiment of a fuel injection valve according to the present invention.

FIG. 6 shows a second embodiment of a fuel injection valve according to the present invention. In this embodiment, the injection orifices 18 with diameter ϕd are so disposed that the center of each of the injection orifices is situated only along a pitch circle with diameters ϕP in the orifice plate 17, as shown in the figure, and additionally, a group of the injection orifices producing a single spray flow are disposed at an equal pitch at angle θa along the circumference of the pitch circle, and so each fuel flow is injected in a similar pattern from each of the injection orifices, thus providing a uniform spray flow.

FIGS. 7 to 11 show a third embodiment of a fuel injection valve according to the present invention. In this embodiment, angle θ1, θ2 or θ3 formed at the fuel injecting side 23 of the orifice plate 17 by an axis 24 of each of the injection orifices 18 disposed in the orifice plate 17 with axis CL (or a straight line 26 that passes through the center of each injection orifices 18 and is parallel to axis CL of the fuel injection valve at the fuel injecting side 23 of the orifice plate 17) of the fuel injection valve increases with an increase in distance L1, L2 or L3 between each injection orifice and a basic axis 25 which passes through the centre of the orifice plate 17 and crosses at a right angle the radial component of the direction of injection of fuel spray flows so that the relationship θ1<θ2<θ3 is established when L1, L2 and L3 are made to have the relationship L1<L2<L3, and so a collision among fuel flows 20 injected from respective injection orifices in each spray flow 21 is prevented, thus providing generally favourable spray flows 21.

Figure 12:
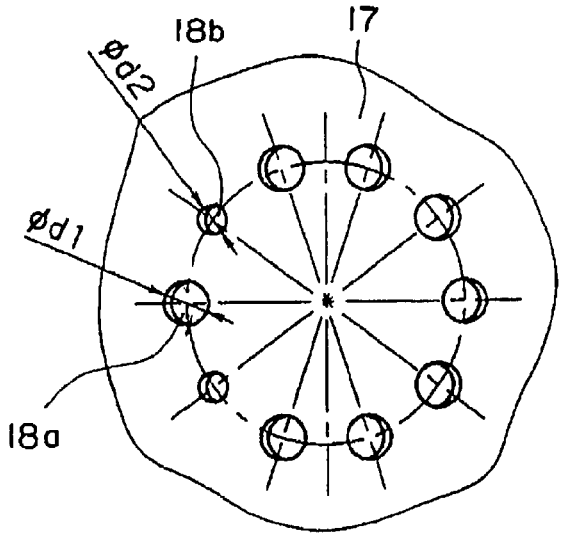
FIG. 12 is a partial plan view showing the orifice plate of a fourth embodiment of a fuel injection valve according to the present invention.
Figure 13:
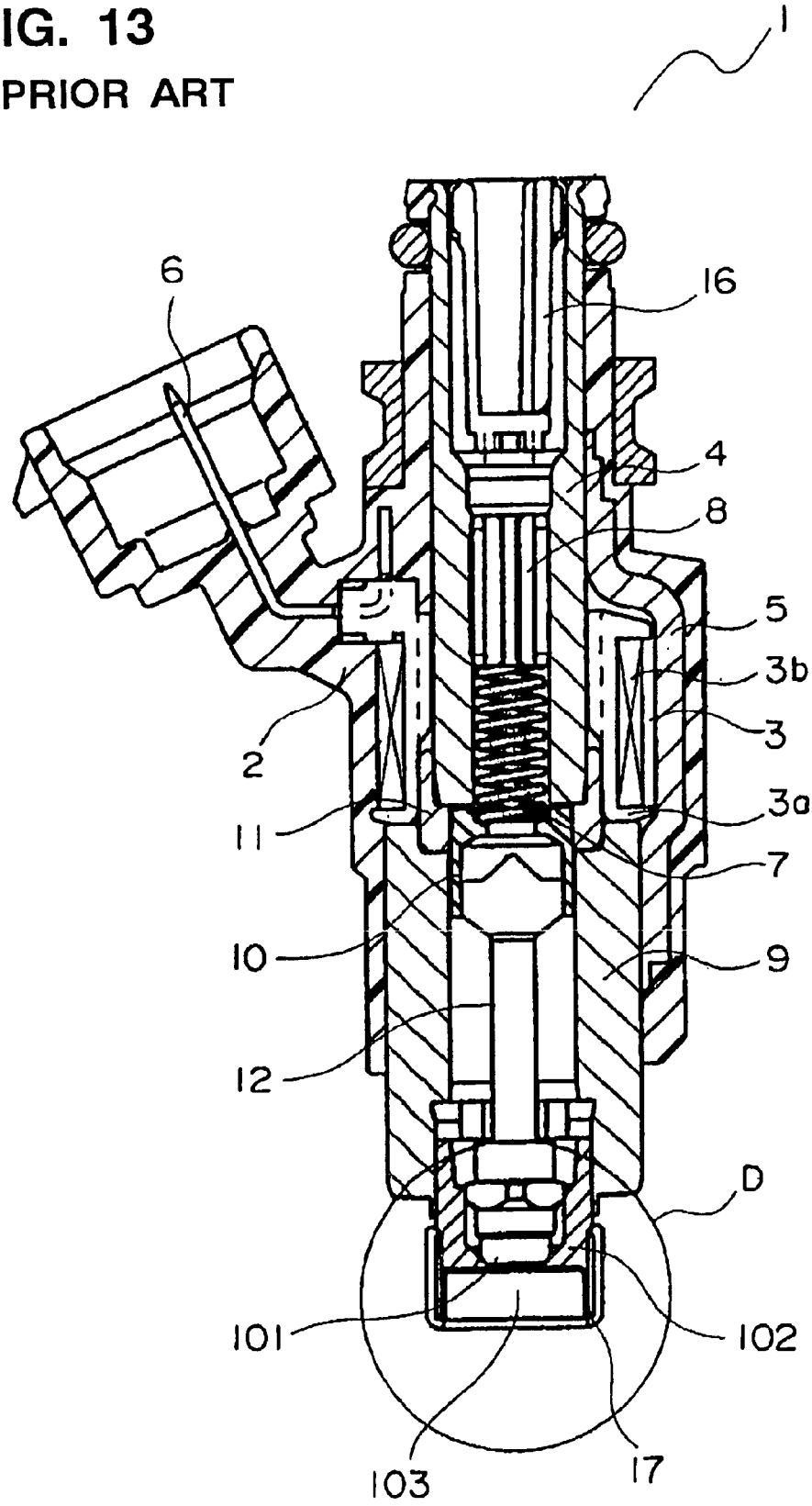
FIG. 13 PRIOR ART
FIG. 13 is a longitudinal cross-sectional elevation of a known fuel injection valve.
Figure 14:
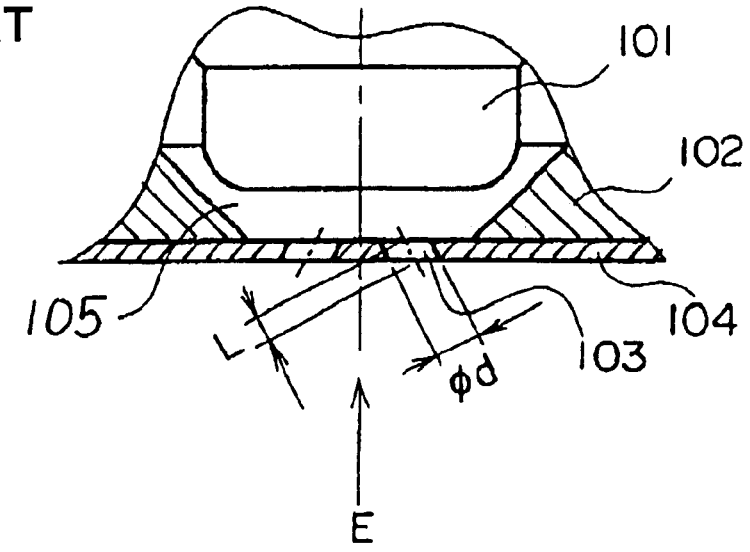
FIG. 14 PRIOR ART
FIG. 14 is an enlarged side view of the fuel injection valve of FIG. 13.
Figure 15:
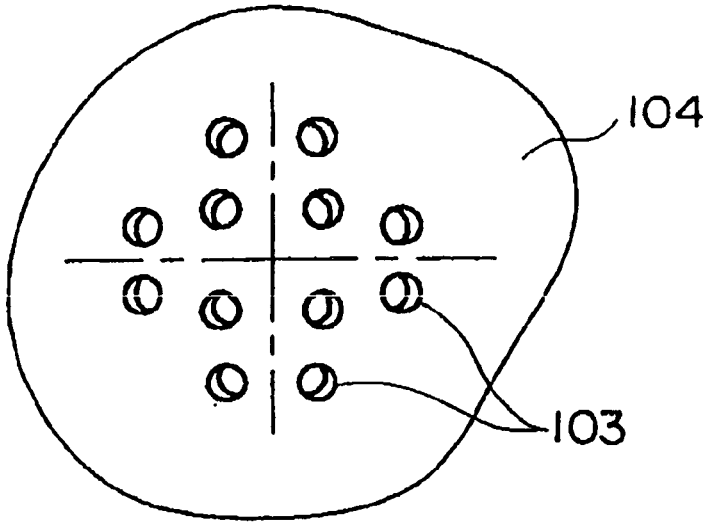
FIG. 15 PRIOR ART
FIG. 15 is an enlarged plan view of the injection orifices of the fuel injection valve of FIG. 13.

FIG. 12 shows a fourth embodiment of a fuel injection valve according to the present invention. In this embodiment, a plurality of said injection orifices 18*a* and 18*b* formed in the orifice plate 17 consist of two groups of orifices with their respective diameters ϕd1 and ϕd2 in the fuel injection valve 1 wherein the diameter of the fuel flow path 14*c* (ϕD1), the diameter of the injection orifice group having larger diameter (ϕd1), the diameter of the pitch circle (ϕP) and the depth in the axial direction of the fuel cavity 14*d* (t) are made to have the relationships ϕD1+ϕd1<ϕP and t<ϕd1, thus providing favorable spray flows even if fuel is distributed unevenly between the two spray flows 21.

As described above, a fuel injection valve of this invention can provide advantages such as the following:

(1) By disposing a plurality of injection orifices in the orifice plate only along diameter ϕP of a single pitch circle with its center coinciding with the axis of the fuel flow path in the fuel injection valve wherein the diameter of the fuel flow path 14*c* (ϕD1), the diameter of each of the injection orifices (ϕd), the diameter of the pitch circle (ϕP) and the depth in the axial direction of the fuel cavity 14*d* (t) are made to have the relationships ϕD1+ϕd<ϕP and t<ϕd, the production of satisfactorily atomized fuel spray flows at a large spray angle can be achieved.

(2) By disposing a group of injection orifices forming a single spray flow at an even pitch along the circumference of the pitch circle passing through the center of each of the injection orifices in the orifice plate of the fuel injection valve, the production of even further uniform spray flows can be achieved.

(3) By forming injection orifices in the orifice plate in the fuel injection valve so that the angle formed at the fuel injecting side of the orifice plate by the axis of each of the injection orifices with the straight line which passes through the center of injection orifice and is parallel to the axis of the fuel injection valve increases with an increase in the distance between each of the injection orifices and a basic axis which passes through the center of the orifice plate and crosses at a right angle the radial component of the direction of injection of fuel spray flows, the production of uniform spray flows can be achieved due to a lesser level of interference among fuel flows forming each spray flow.

(4) By forming injection orifices consisting of more than two groups of orifices with different diameters in the orifice plate of the fuel injection valve wherein the diameter of the fuel flow path ($\phi D1$), the diameter of the injection orifice group having the largest diameter ($\phi d1$), the diameter of the pitch circle ($\phi P$) and the depth in the axial direction of the fuel cavity (t) are made to have the relationships $\phi D1+\phi d1<\phi P$ and $t<\phi d1$, the production of favorable spray flows can be achieved even if fuel distribution is uneven among a plurality of spray flows.

What is claimed is:

1. A fuel injection valve comprising:

an orifice plate having injection orifices formed therein;

a valve seat having a valve seating situated in the upstream section of said injection orifices;

a fuel flow path in a cylindrical form formed within said valve seat;

a fuel cavity formed in the space between said fuel flow path and said orifice plate having said injection orifices and situated directly above said injection orifices; and a valve member supported by said valve seat in a way enabling reciprocation and having an abutting section that can be settled in the valve seating formed in said valve seat wherein the abutting section is settled in and lifted off said valve seat, and producing a plurality of spray flows consisting of a plurality of fuel flows injected out of said injection orifices formed in said orifice plate;

wherein said injection orifices are disposed only along diameter $\Phi P$ of a single pitch circle with its center coinciding with the axis of said fuel flow path, and the diameter of said fuel flow path ($\Phi D1$), the diameter of each of said injection orifices ($\Phi d$), $\Phi P$ and the depth in the axial direction of said fuel cavity (t) are made to have the relationships $\Phi D1+\Phi d<\Phi P$ and $t<\Phi d$, wherein a group of the injection orifices forming a single spray flow are disposed at an equal pitch along a circumference of the single pitch circle.

2. A fuel injection valve comprising:

an orifice plate having a plurality of injection orifices formed therein;

a valve seat having a valve seating situated in the upstream section of said injection orifices;

a fuel flow path in a cylindrical form formed within said valve seat;

a fuel cavity formed in the space between said fuel flow path and said orifice plate having a plurality of injection orifices and situated directly above a plurality of said injection orifices; and a valve member supported by said valve seat in a way enabling reciprocation and having an abutting section that can be settled in the valve seating formed in said valve seat wherein the abutting section is settled in and lifted off said valve seat, and producing a plurality of spray flows consisting of a plurality of fuel flows injected out of injection orifices formed in said orifice plate;

wherein a plurality of said injection orifices are disposed only along diameter $\Phi P$ of a single pitch circle with its center coinciding with the axis of said fuel flow path, and the diameter of said fuel flow path ($\Phi D1$), the diameter of each of said injection orifices ($\Phi d$), $\Phi P$ and the depth in the axial direction of said fuel cavity (t) are made to have the relationships $\Phi D1+\Phi d<\Phi P$ and $t<\Phi d$, a plurality of said injection orifices consisting of more than two groups of injection orifices with different diameters in said orifice plate of said fuel injection valve, wherein the diameter of said fuel flow path ($\Phi D1$), the diameter of the group of said injection orifices with the largest diameter ($\Phi d1$), the diameter of said pitch circle ($\Phi P$) and the depth in the axial direction of said fuel cavity (t) are made to have the relationships $\Phi D1+\Phi d1<\Phi P$ and $t<\Phi d1$.

* * * * *